US009694381B2

(12) United States Patent
Mohr

(10) Patent No.: US 9,694,381 B2
(45) Date of Patent: Jul. 4, 2017

(54) COMBINATION NOZZLE AND DEVICE FOR APPLYING A VISCOUS MATERIAL TO A COMPONENT EDGE

(71) Applicant: FRAUNHOFER-GESELLSCHAFT ZUR FOERDERUNG DER ANGEWANDTEN FORSCHUNG E.V., Munich (DE)

(72) Inventor: Frank Mohr, Bremerhaven (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 66 days.

(21) Appl. No.: 14/435,837

(22) PCT Filed: Oct. 21, 2013

(86) PCT No.: PCT/EP2013/003165

§ 371 (c)(1),
(2) Date: Apr. 15, 2015

(87) PCT Pub. No.: WO2014/063806

PCT Pub. Date: May 1, 2014

(65) Prior Publication Data

US 2016/0052012 A1 Feb. 25, 2016

Related U.S. Application Data

(60) Provisional application No. 61/718,832, filed on Oct. 26, 2012, provisional application No. 61/718,838, filed on Oct. 26, 2012.

(30) Foreign Application Priority Data

Oct. 26, 2012 (DE) ..... 10 2012 021 590
Oct. 26, 2012 (DE) ..... 10 2012 021 591
Mar. 4, 2013 (DE) ..... 10 2013 003 688

(51) Int. Cl.
*B05C 5/02* (2006.01)
*B05C 17/005* (2006.01)
(Continued)

(52) U.S. Cl.
CPC ..... *B05C 5/0204* (2013.01); *B05B 7/0815* (2013.01); *B05B 15/08* (2013.01);
(Continued)

(58) Field of Classification Search
None
See application file for complete search history.

(56) References Cited

U.S. PATENT DOCUMENTS 4,291,642 A * 9/1981 Kolc ..... B05C 5/02 118/401
4,295,439 A * 10/1981 Kruszona ..... B05C 5/0216 118/317
(Continued)

FOREIGN PATENT DOCUMENTS

DE 3232082 A1 4/1983 ..... B05C 5/02
DE 69521658 T2 5/2002 ..... B05C 5/02
(Continued)

OTHER PUBLICATIONS

International Search Report mailed Mar. 20, 2014 in corresponding application No. PCT/EP2013/003165.
(Continued)

*Primary Examiner* — Binu Thomas
(74) *Attorney, Agent, or Firm* — Renner Kenner Greive Bobak Taylor & Weber

(57) ABSTRACT

A combination nozzle and a device for applying a viscous material, particularly an adhesive, to a component edge includes two wide-slot nozzles lying close to one another.
(Continued)

The first nozzle applies the viscous material and the second nozzle supplies a gas such as air for shaping the applied material bead. A nozzle mount has a guide roller placed on and movable about the edge of the component during application. A connector element via a connecting mechanism allows movement of the nozzle mount parallel to the surface normal on the component edge to press the guide roller against the edge during the application process by a spring mechanism. With the proposed combination nozzle and the proposed device, an optimal wetting of the component edge with the viscous material can be achieved, and additionally the component tolerances are compensated without the necessity of an elaborate sensor system.

11 Claims, 9 Drawing Sheets

(51) Int. Cl.

| | |
|---|---|
| ***B05B 7/08*** | (2006.01) |
| ***B05B 15/08*** | (2006.01) |
| ***B05C 11/06*** | (2006.01) |
| *B05C 11/10* | (2006.01) |

(52) U.S. Cl.
CPC ..... *B05C 5/02* (2013.01); *B05C 5/0216* (2013.01); *B05C 5/0295* (2013.01); *B05C 11/06* (2013.01); *B05C 17/00589* (2013.01); *B05C 11/1018* (2013.01)

(56) References Cited

U.S. PATENT DOCUMENTS

| | | | | |
|---|---|---|---|---|
| 4,778,642 | A | 10/1988 | Lee et al. | 264/510 |
| 5,573,625 | A * | 11/1996 | Lovell | B05C 5/0216 118/409 |
| 6,017,578 | A | 1/2000 | Trautmann et al. | 427/8 |
| 6,589,344 | B2 * | 7/2003 | Cho | B05C 5/0212 118/323 |
| 6,660,087 | B2 * | 12/2003 | Murakami | B05C 5/0216 118/323 |
| 2002/0132038 | A1 | 9/2002 | Birmingham | 427/8 |
| 2005/0056213 | A1 | 3/2005 | Iimori et al. | 118/410 |
| 2006/0068113 | A1 * | 3/2006 | Aoyama | B05C 11/06 118/300 |
| 2010/0075058 | A1 | 3/2010 | Rademacher et al. | 427/427.3 |
| 2012/0070565 | A1 | 3/2012 | Meier et al. | 427/8 |
| 2012/0258246 | A1 | 10/2012 | Saine et al. | 427/207.1 |

FOREIGN PATENT DOCUMENTS

| | | | | |
|---|---|---|---|---|
| EP | 0453936 | A2 | 10/1991 | B05C 5/02 |
| EP | 227631 | A1 | 1/2011 | B05C 5/02 |
| EP | 2277631 | A1 | 1/2011 | B05C 5/02 |
| JP | H05115825 | A | 5/1993 | B05C 5/00 |
| JP | 2004221244 | A | 8/2005 | B05C 11/10 |
| WO | WO 03/051550 | A1 | 6/2003 | B21B 45/02 |
| WO | WO 2004/039505 | A1 | 5/2004 | B05C 5/02 |

OTHER PUBLICATIONS

Written Opinion mailed Mar. 20, 2014 in corresponding application No. PCT/EP2013/003165.

* cited by examiner

COMBINATION NOZZLE AND DEVICE FOR APPLYING A VISCOUS MATERIAL TO A COMPONENT EDGE

CROSS-REFERENCE TO RELATED APPLICATION

This is a §371 application of International patent application number PCT/EP2013/003165 filed on Oct. 21, 2013, which claims the benefit of U.S. application No. 61/718,832 filed on Oct. 26, 2012; U.S. application No. 61/718,838 filed on Oct. 26, 2012; German application number 10 2012 021 590.8 filed on Oct. 26, 2012; German application number 10 2012 021 591.6 filed on Oct. 26, 2012; and German patent application number 10 2013 003 688.7 filed on Mar. 4, 2013, all of which are incorporated herein by reference.

TECHNICAL FIELD

The present invention relates to a combination nozzle and a device for applying a viscous material, particularly an adhesive, to the edge of a component.

BACKGROUND ART

Applying viscous materials, for example adhesives, to component edges makes high demands on the application mechanism because only slight deviations from the edge guides can be tolerated, and complete wetting of the component edge is to be achieved. For example, component edges on milled carbon fibre reinforced plastic (CFRP) components need to be sealed to provide protection against corrosion. Sealing can take place manually, in an automated manner or in a partly automated manner with the use of a suitable applicator.

High clock rates require an automated or partly-automated solution, for example with the use of a robot, because manual sealing is too time-consuming and consequently not cost-effective. Frequently, applicators hitherto used for automated adhesive application are associated with a disadvantage in that in the case of components subject to tolerances, the nozzle cannot follow the deviations of the component edge. This results in undesirable contact of the nozzle with the component, or in excessive spacing from the component in the case of a predetermined robot path. Furthermore, many conventional applicators and nozzles are unable to operate in narrow breakthroughs in the component.

There is a further problem in that the edges of modern composite materials, e.g. CFRP, have different edge widths as a result of their variable design. Programming a robot path for central alignment of the applicator is correspondingly expensive. While there is the option of using a suitable sensor system that transmits correction signals for height correction and if applicable for lateral correction directly to the robot control system, it is, however, necessary for there to be adequate space for the sensor system. Moreover, a sensor control system is costly, complex, and can cause considerable delay times.

In addition, during the application of adhesive there is a problem in that in the case of narrow component edges, despite the use of wide-slot nozzles, in the hitherto-used nozzles the applied adhesive bead usually has a semicircular shape, and consequently the edges of the component surfaces are often not wetted. However, edge sealing providing full wetting of the surface would require a lenticular cross-sectional shape or the shape of a flat segment of a circle.

Because of the above-mentioned problems the component edges on milled CFRP-components with limited accessibility and on component breakthroughs have hitherto usually been sealed manually. Component edges with very tight radii and breakthroughs are exclusively sealed manually. In this process the adhesives are applied manually with paint brushes or from cartridges. After this, the semicircular adhesive bead is distributed on the component edge with the use of a roller, and excess adhesive, which runs off on the sides of the component, or on surfaces that do not require wetting, are cleaned manually.

U.S. Pat. No. 4,778,642 shows a nozzle for applying a viscous material, which nozzle has several additional nozzle apertures for influencing the application of material by means of an air stream. In this design the nozzle aperture for the application of material is encompassed by four air nozzles which during the application of material blow obliquely into the material strand emanating from the nozzle, and in so doing form said material strand already prior to application. Such a technique is also known from so-called whirling nozzles. Furthermore, in the nozzle which forms the subject of this printed publication further air nozzles are arranged at greater spacing from the nozzle aperture for the application of material, which further air nozzles act on the form of the already applied material bead. The problems associated with the application of a viscous material to component edges and in confined component breakthroughs or to component edges with tight radii are not addressed in this printed publication. Nor is the nozzle shown, because of its size determined by the various nozzle openings, suitable for such applications.

It is the object of the present invention to state a nozzle and a device for applying a viscous material, particularly an adhesive, to component edges, which nozzle and device allow optimal wetting of the component edges and precise guidance of the nozzle along the component edges and are also suitable for tight radii and component breakthroughs.

SUMMARY OF THE INVENTION

The object is met by the combination nozzle and by the application device as disclosed herein. Advantageous embodiments of the nozzle and of the device are provided in the following description and in the exemplary embodiments.

The proposed combination nozzle has a first nozzle channel for the viscous material, which nozzle channel leads to a first nozzle aperture, and a second nozzle channel for a gaseous medium, particularly for air, which nozzle channel leads to a second nozzle aperture. The two nozzle channels extend in the combination nozzle at an angle to each other, which angle is between 0° and 10°, preferably between 0° and 5°. The two nozzle apertures are designed as wide-slot nozzles; their width is thus greater than their length. The two nozzle apertures are arranged in the longitudinal direction one behind the other at a centre distance of between 3 and 5 mm.

With this, preferably single-part, design of the nozzle as a combination nozzle with two wide-slot nozzles lying close to one another, economical, non-contacting automated edge sealing with a flat material bead and thus well wetted component edges is achieved, which edge sealing does not require any subsequent manual rework or any subsequent cleaning process. The viscous material, for example an adhesive, is applied to the component edge through the first wide-slot nozzle. Directly thereafter, at a short fixed distance the second wide-slot nozzle for the gas stream or air stream follows, which gas stream or air stream blows onto the already applied material bead, thus widening and flattening said material bead. By means of the flatter bead, better wetting of the margins of the component edge is enforced. The selection of wide-slot nozzle apertures makes it possible to apply the viscous material at various widths, thus making it possible to adapt to the particular dimensions of the component edge. The width of application can be influenced by way of the process parameters, e.g. the setting of the infeed speed and of the mass flow of the emanating viscous material. The close proximity of the two nozzle apertures relative to each other and the nozzle channels, which are preferably parallel or at least almost parallel to each other, make it possible to achieve a very compact nozzle by means of which the material can be applied even to tight radii or component breakthroughs.

The width of the nozzle apertures is preferably between 3 and 6 mm; the length ≤2 mm. Preferably, the second nozzle aperture is arranged so as to be offset rearwards in the direction parallel to the longitudinal axis of the first nozzle channel or of the surface normal to the component edge by a distance of approximately 4±1 mm relative to the first nozzle aperture in order to achieve optimum influencing of the applied material bead by means of the gas stream or air stream. Thus the air outlet is arranged approximately 3-4 mm higher relative to the component surface than the adhesive outlet.

For applying the viscous material, for example an adhesive, to the edge of a component, the device according to the invention is proposed, which device is hereinafter also referred to as an applicator. During application, this device is moved in an infeed direction along the edge of the component to which the viscous material is to be applied. In this context the term "component edge" refers to a narrow side of the component or of a component region, for example the narrow side of a plate or a glass pane. The device has a nozzle for the viscous material, which nozzle is mounted in or on a nozzle mount. A guide roller (Diabolo) is affixed to the nozzle or to the nozzle mount in such a manner that for applying the viscous material it can be placed to the edge and can be moved along the edge. In this design the guide roller is arranged in such a manner that during the application process it ensures a defined position of the nozzle relative to the edge, particularly the centering of the nozzle relative to the edge, and a constant distance. The nozzle mount is connected, by way of a connecting mechanism, to a connector element by way of which the device or the applicator can be connected to a handling device, a handle or a cartridge. In this manner the applicator can, for example, be connected to a robot arm and can be guided by the robot arm for automated application of the viscous material. In the proposed device the connecting mechanism is designed in such a manner that at least in the direction of the edge of the component, i.e. in a direction parallel to the surface normal on the component edge, it allows a relative movement of the nozzle mount or of the nozzle relative to the connector element, and has a spring mechanism by means of which the guide roller is pressed against the edge during the application process. The mobility of the nozzle mount or nozzle in the direction of the edge is selected in such a manner that as a result of this movement the component tolerances along the edge can be compensated for. This allows fully automated or partly automated sealing of the component edge. As a result of the guide roller, precise guidance of the nozzle along the component edge is ensured. As a result of the mobility of the nozzle mount relative to the connector element or to the handling device, of the handle or the cartridge to which the applicator is affixed, even in the case of component tolerances a constant distance of the nozzle to the component edge is achieved without the need to use expensive sensor systems for this.

In the proposed device the guide roller can be arranged in the infeed direction in front of or behind the nozzle. An arrangement in front of the nozzle is preferably selected when influencing or forming the applied material bead by means of the air stream or gas stream from an additional nozzle aperture is to take place. In an arrangement behind the nozzle the guide roller is preferably designed, particularly formed, in such a manner that influencing or forming of the material bead applied with the nozzle takes place by the guide roller. Thus in this case the guide roller has a dual function: on the one hand ensuring a defined position of the nozzle relative to the edge during the application process, and on the other hand forming the applied material bead. In this context the term "forming" also refers to straightening or smoothing the material bead.

Consequently, the nozzle mount can be made to be correspondingly narrow so that in this manner material application can also be carried out on narrow component breakthroughs.

The connecting mechanism can be implemented in various ways. In an advantageous embodiment the connecting mechanism is designed as an angle lever, wherein the nozzle mount represents an arm of this angle lever or is attached to this angle lever. In this arrangement the nozzle can, for example, be a wide-slot nozzle by means of which the viscous material is applied to the component edge. The angle lever makes it possible for the nozzle mount with the nozzle to be movable in the direction of the surface normal relative to the component edge. This applicator is, for example, connected to an automation device (e.g. robot) and to the metering system for the viscous material. The guide roller contacts the component edge and moves ahead of, or behind, the nozzle in the movement direction or infeed direction of the applicator. Component tolerances in the normal direction are compensated for by the spring mechanism in the angle lever. Therefore, by way of the guide roller, the applicator maintains continuous contact with the component edge.

In an improvement of this embodiment a sensor for acquiring movements of the angle lever is affixed to the applicator, wherein the measurement data of said sensor can be used for controlling the automation device. For example, the movement of the angle lever can be acquired by way of a distance laser as a sensor in order to transmit deviations from the pre-programmed track of the automation device to the track control system, which subsequently corrects the track accordingly.

By means of this applicator, automatable edge sealing on components subject to tolerances and with tight radii and restricted access becomes possible. This design is associated with a very considerable advantage in that it is possible to have a slim design of the applicator tip by means of which even breakthroughs and cut-outs with small radii can be achieved. As a result of the guide roller or press roller, the applicator has permanent spring-force-controlled contact with the component and follows the component edge even in the case of deviations of the component in the surface normal.

In a further embodiment the connecting mechanism is designed in such a manner that in addition to the movement parallel to the surface normal of the component edge said connecting mechanism is also movable perpendicularly to the surface normal and to the infeed direction. For both movements in each case a spring mechanism has been integrated that presses the guide roller against the component edge or counteracts any deflection from a centre position of the guide roller. Here again, preferably a wide-slot nozzle is used for applying the viscous material. The applicator can be connected to an automation device, for example to a robot or to an XYZ-Cartesian portal system, and to a corresponding metering system for the viscous material. During application of the viscous material, the guide roller contacts the component edge and moves ahead of or behind the nozzle in the movement direction or infeed direction. Because of the nozzle mount, which is movable in two spatial directions relative to the connector element, component tolerances are compensated for, both in the normal direction and in the direction orthogonal to the infeed direction, by the self-resetting spring mechanisms. During the application process the guide roller itself remains in constant contact with the component edge, and thus as a result of the mechanical coupling with the nozzle ensures a constant space between the nozzle and the component. In this embodiment, too, no expensive sensor system is required for maintaining a defined position of the nozzle relative to the component edge.

With this applicator it is possible to achieve sensor-less automatable edge sealing on components with a variable edge width, which components are subject to tolerances. This design provides a very considerable advantage in that there is no complicated sensor control system with associated delay times. The applicator maintains constant contact, controlled by spring force, with the component, and follows the component edge even in the case of oscillations of the handling device, which oscillations are due to mass inertia or resonance.

In a further embodiment the connecting mechanism is designed as a parallelogram guide. The parallelogram guide allows an angular movement of, for example, ±10 mm and thus a displacement of the nozzle or of the nozzle mount parallel to the surface normal relative to the component edge by approx. 20 mm. This displacement is also self-resetting as a result of spring action, and consequently corresponding component tolerances are compensated for. In the preferred embodiment the connector element of this applicator is designed in such a manner that it can be affixed to a cartridge for the material to be applied, for example an adhesive or sealant. In this process the applicator is preferably directly screwed onto the cartridge applicator gun. As a result of the self-resetting displacement due to the parallelogram guide in conjunction with a spring mechanism any inaccuracies by the user during manual application to the edges with tight radii are compensated for by means of the spring or the spring mechanism. To this effect, at the beginning of the application process the user presses the guide roller against the component edge and thus moves the parallelogram to its centre position. By means of this preload of the spring in the centre position of the parallelogram the user ensures that there is continuous contact of the guide roller or press roller with the component, and can thus fully concentrate on the position of the nozzle relative to the component in the direction of curves. During the application process the user aims to maintain the centre position of the parallelogram. The guide roller always moves ahead of, or behind, the nozzle in the direction of movement and contributes to stabilising the track in the tangential direction. In this embodiment and also in the other embodiments, in the case of very narrow edges the preferably used wide-slot nozzle can also be replaced by a round nozzle.

This applicator makes it possible to achieve economical semi-automatic edge sealing on component edges with tight radii on breakthroughs. The most important advantages are the permanent component contact as a result of the parallelogram, and the tangential guiding as a result of the guide roller, which make it possible to achieve faster sealing of component edges even with manual operation.

The proposed device and the proposed combination nozzle, which is preferably used with said device, can be used, for example, in component edge sealing of doors or window panes in aviation and automotive applications, or in seam sealing in the construction of rotor blades for wind turbines.

BRIEF DESCRIPTION OF THE DRAWINGS

The proposed combination nozzle and the proposed applicator are explained in more detail below with reference to exemplary embodiments in conjunction with the drawings. The following are shown.

BEST MODE FOR CARRYING OUT THE INVENTION

An example of an advantageous embodiment of the proposed combination nozzle is shown in FIG. 1 in various views. FIG. 1*a* shows an isometric view of the combination nozzle, in which on the connector side the aperture of the nozzle channel 2 for the supply of the viscous material and the aperture of the nozzle channel 4 for the supply of air are shown. The nozzle tapers towards the nozzle tip, as is shown in FIG. 1*a*.

Figure 1A:
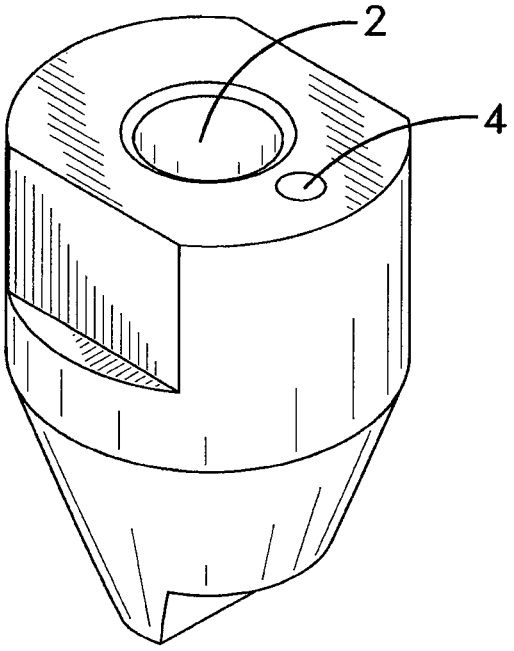
FIGS. 1*a*)-d) show various views of one embodiment of the proposed combination nozzle.
Figure 1B:
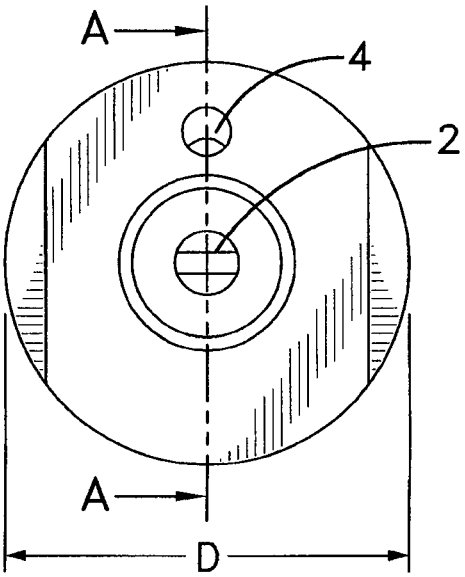

FIG. 1*b* shows a top view of this nozzle from the connector side, in which view the rear apertures to the nozzle channels 2, 4 are also shown. In this example the diameter D of the nozzle at the widest point is 18 mm; the length L is 25 mm.

Figure 1C:
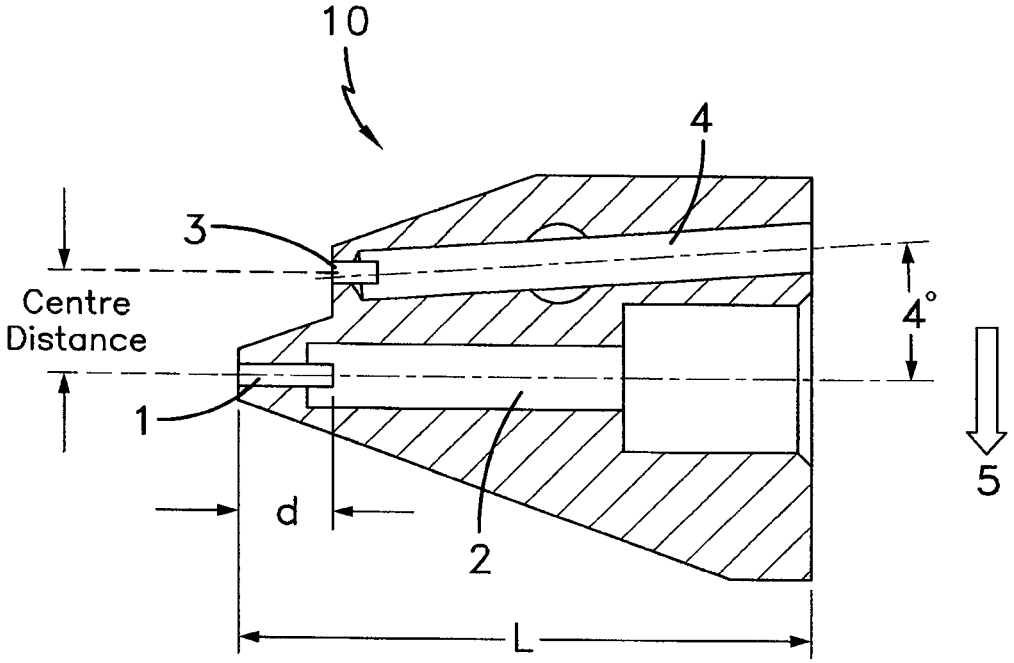

FIG. 1*c* shows a section view along the section line AA of FIG. 1*b*. This section view shows the alignment of the two nozzle channels 2, 4 which lead to the nozzle aperture 1 for the viscous material and to the nozzle aperture 3 for the air outlet. In this example the nozzle channel 4 for the air stream is inclined by an angle of 4° relative to the nozzle channel 2 for the viscous material. This inclination is necessary in the present example in order to arrange the nozzle aperture 3 for the air outlet at an optimally short distance behind the nozzle aperture 1 for the viscous material. In the present example this distance is 4 mm (designated as "centre distance" in FIGS. 1*c* and 1*d*).

Figure 1D:
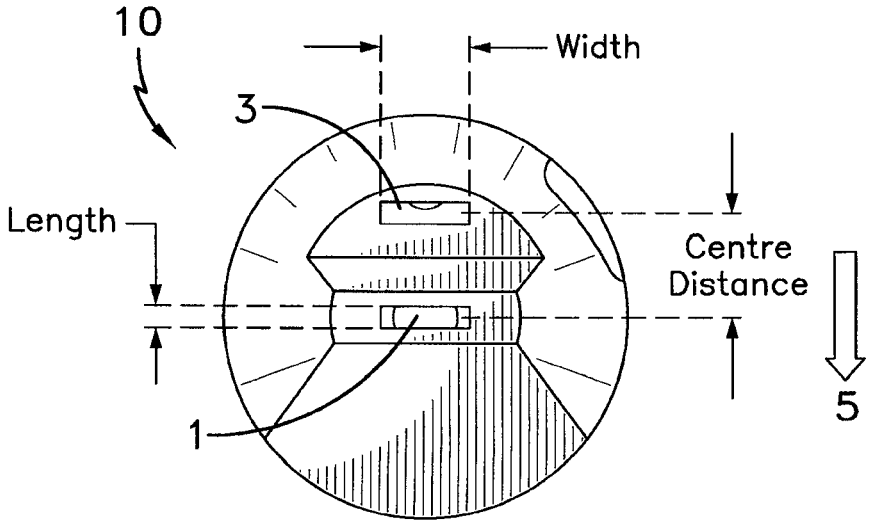

FIG. 1*d* shows a bottom view of the nozzle, in which the two nozzle apertures 1, 3 are shown which are designed as wide-slot nozzles. In this example the nozzle apertures have a width of 4 mm and a length of 1 mm designated as "width" and "length" respectively in FIG. 1*d*, wherein the longitudinal direction corresponds to the distance direction of the two nozzles or to the infeed direction 5 of the nozzle during the application of the viscous material. In FIGS. 1*c* and 1*d* the infeed direction 5 is indicated by an arrow.

The section view of FIG. 1*c* also shows the height offset d of the air outlet aperture 3 relative to the nozzle aperture 1 for the viscous material. In the present example this offset d is 4 mm; it is required to make it possible to achieve optimal forming, on the component edge, of the viscous material applied by way of the nozzle aperture 1. The presently selected dimensions make it possible to apply a highly viscous material, for example an epoxy adhesive with a viscosity of ≥100 Pa·s, which after application by way of the nozzle aperture 3 of the air nozzle is formed into a flat shape that in cross section is almost lenticular. Because of this effect, wetting of the component edge during the application of the viscous material is clearly improved. Due to the short distance between the two nozzle apertures 1, 3 the nozzle can be used advantageously even on tight component breakthroughs or in the region of tight component radii.

Figure 2:
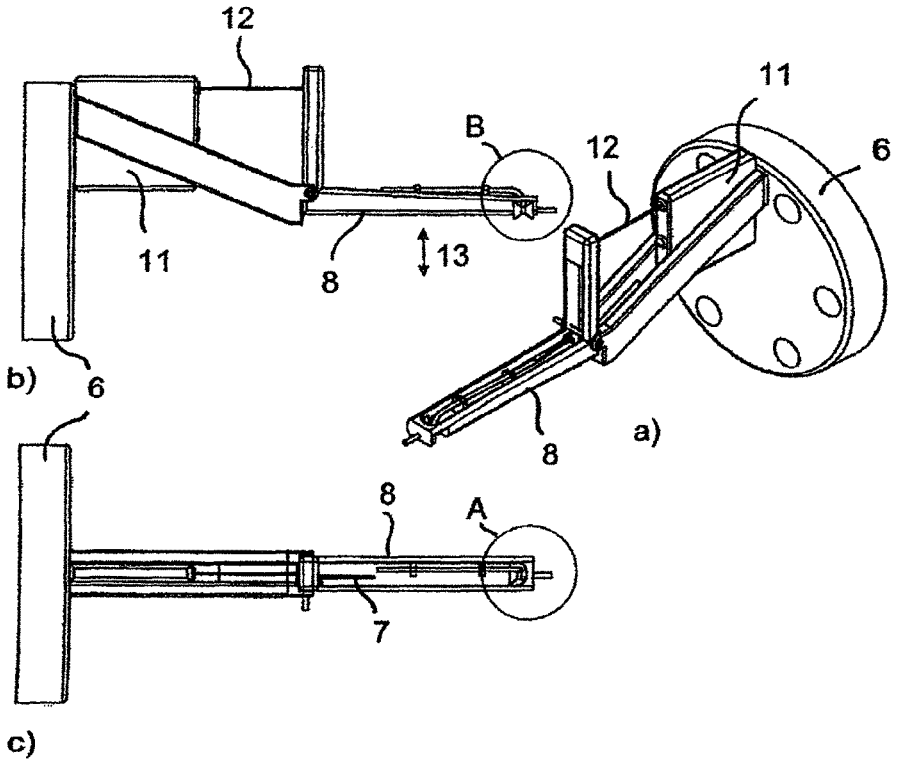
FIGS. 2*a*)-e) show various views of a first embodiment of the proposed applicator.

FIG. 2 shows a first example of a device or of an applicator according to the present invention. In this example the applicator comprises an angle lever 8 whose front part at the same time provides the holding device for the nozzle 10, and whose rear part is rigidly connected, by way of a robot flange 6 as a connector element, to a robot. The angle lever 8 makes it possible to achieve movement of the front cantilever arm with the nozzle 10 in the direction parallel to the surface normal onto the component edge, wherein said angle lever 8 has a spring 7 that presses the nozzle mount or nozzle with the guide roller 9 against the component edge. FIG. 2*a* shows an isometric view of such an applicator, with both the angle lever 8 and the robot flange 6 being shown. By way of a laser sensor 11, whose laser beam 12 is indicated diagrammatically, the movement of the angle lever 8 is measured. Such a movement occurs during the application of the viscous material in those cases where the component edge is subject to tolerances and thus does not correspond to the programmed track. By means of measuring the movement of the angle lever it is then possible to acquire the deviation and to correspondingly correct the robot path.

Figure 2D:
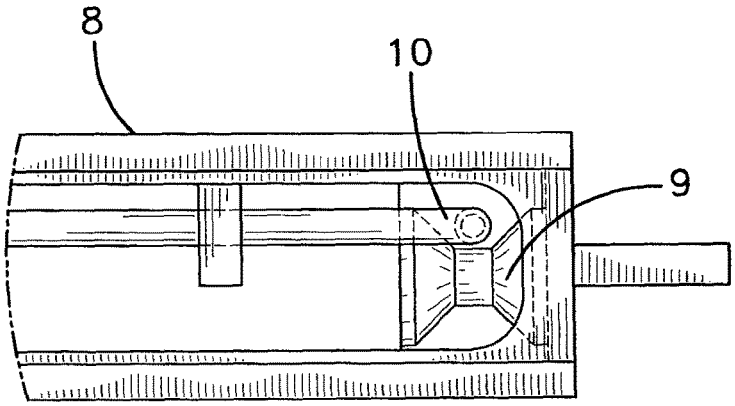
Figure 2E:
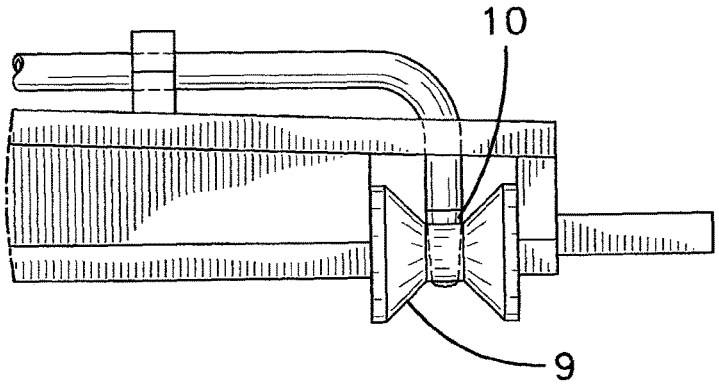

FIG. 2*b* shows a lateral view of this applicator, wherein again the robot flange 6, the angle lever 8 and the laser sensor 11 are shown. At the front part of the angle lever 8 in this example the guide roller 9 is indicated. Moreover, in the figure the direction of movement 13 of the angle lever 8 is indicated by an arrow. The front part of this angle lever 8 is also shown in the detailed view B of FIG. 2*e*. In this embodiment, and also in the further embodiments, the guide roller 9 has a central taper with flanks arising on both sides, as shown in the cross-sectional view of FIG. 2*e*. In this manner centring of the nozzle 10, which in the infeed direction is arranged behind the guide roller 9, relative to the component edge is achieved. In FIG. 2*e* only a supply part of the nozzle 10 is shown, which part in a rear region leads into a material hose for supplying the viscous material.

FIG. 2*c* shows a top view of the applicator, wherein on the one hand again the supply part of the nozzle, and on the other hand also a spring 7 are shown, by means of which spring 7 the guide roller 9 is pressed against the component edge. FIG. 2*d* in turn shows the front part of the angle lever in detail. This diagram more clearly shows the position of the nozzle 10 behind the guide roller 9.

Figure 3:
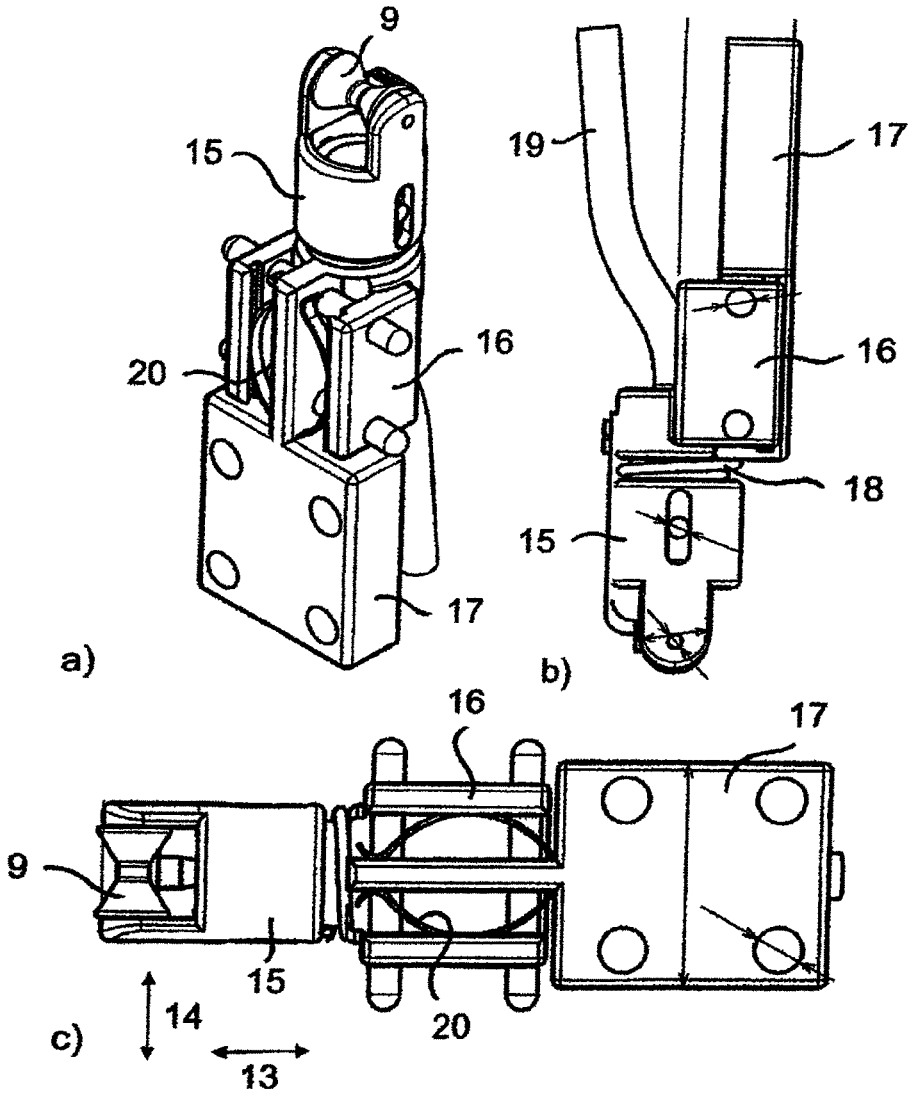
FIGS. 3*a*)-d) show various views of a second embodiment of the proposed applicator.

FIG. 3 shows a further example of a possible design of the proposed applicator. In this example the applicator makes it possible for the nozzle mount or for the nozzle head 15 to move both in the direction parallel to the surface normal towards the component edge and also in the direction perpendicular to the infeed direction and this surface normal. FIG. 3*a* shows an isometric view of this applicator. The applicator has a nozzle head 15 to which the guide roller 9 has been affixed. This nozzle head also comprises the nozzle (not shown in this diagram). By way of a spring 18 and a sliding block guide 16 the nozzle head 15 is connected to a mounting plate 17 via which the applicator can be affixed to a handling device. In the lateral view of FIG. 3*b* the mounting plate 17, the spring 18 and the nozzle head 15 are shown again. This diagram also shows the material hose 19 by way of which the viscous material is fed to the nozzle head 15.

Figure 3D:
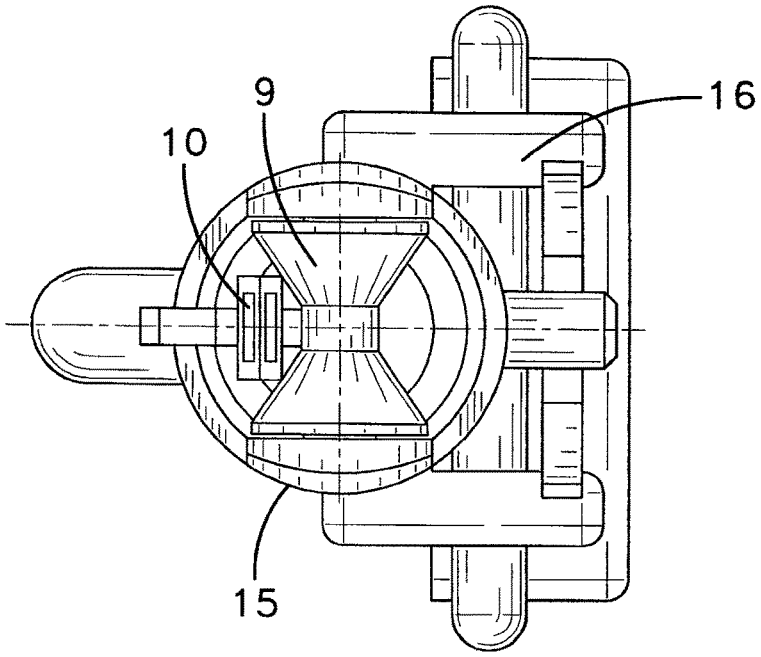

FIG. 3*c* shows a front view of this applicator in which the two directions of movement of the nozzle head 15 with the guide roller 9, the direction of movement 13 in the direction parallel to the surface normal towards the component edge, and the direction of movement 14 in the direction perpendicular to the infeed direction and perpendicular to the surface normal are shown. By way of the sliding block guide 16 the direction of movement 14 perpendicular to the surface normal becomes possible. The figure shows the springs 20 by way of which the parallel displacement, which is possible with the sliding block, is in each case re-set to a centre position. The spring 18 is used to press the guide roller 9 onto the component edge. FIG. 3*d* shows a bottom view that shows the position of the nozzle 10 relative to the guide roller 9.

With the use of such an applicator, during the application of the viscous material any component tolerances of the component edge are compensated for by the applicator itself, both in the direction parallel to the surface normal and in the direction perpendicular to the aforesaid, by way of the corresponding possibilities of movement, and consequently there is no need to use an expensive sensor system for track correction of the handling device.

Figure 4:
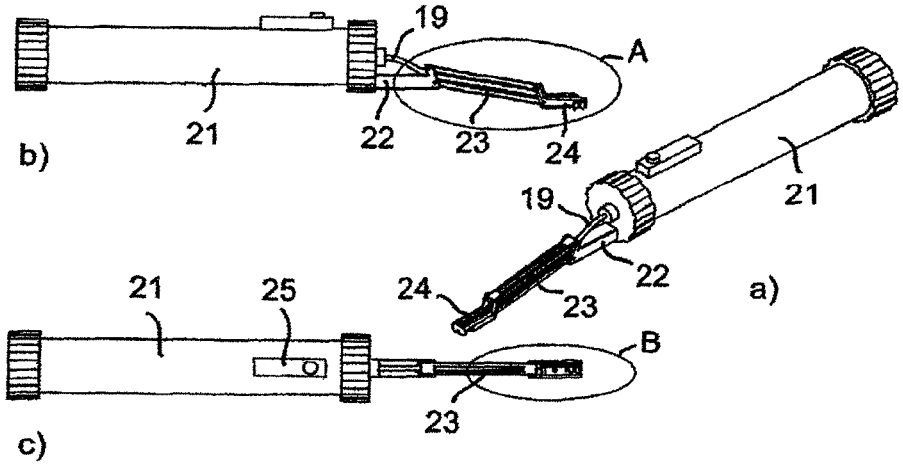
FIGS. 4*a*)-e) show various views of a third embodiment of the proposed applicator.
Figure 4D:
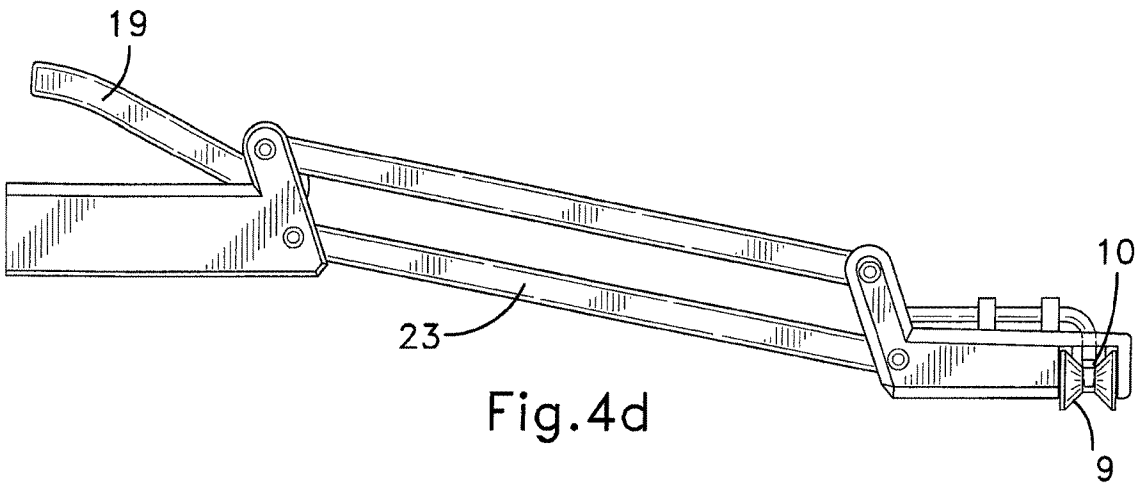

A further embodiment option of the proposed applicator is shown in FIG. 4 in various views. This embodiment shows a manual applicator for edge sealing on tight radii and breakthroughs in components. In this design the applicator is directly connected to a pneumatic cartridge applicator gun 21 as is shown in the isometric view of FIG. 4*a*. The applicator itself has a corresponding connector element 22 that, by way of a parallelogram guide 23, is connected to the nozzle mount 24, in the present example also referred to as an "applicator head". FIG. 4*b* shows a lateral view, and FIG. 4*c* a top view of the applicator connected to the cartridge applicator gun 21. FIG. 24*d* shows the partial view A from FIG. 4*b*. This Figure shows the parallelogram guide 23, the nozzle mount 24, and part of the nozzle 10 of the applicator. On the front part a guide roller 9 for guiding the nozzle along the component edge is attached. The parallelogram guide again makes it possible for the nozzle to move in the direction of movement 13, indicated by an arrow, parallel to the surface normal to the component edge. In this design the guide roller 9 is reached by way of the spring action of a spring used in the parallelogram guide 23. The nozzle 10 is connected to the cartridge applicator gun 21 by way of a material hose 19.

Figure 4E:
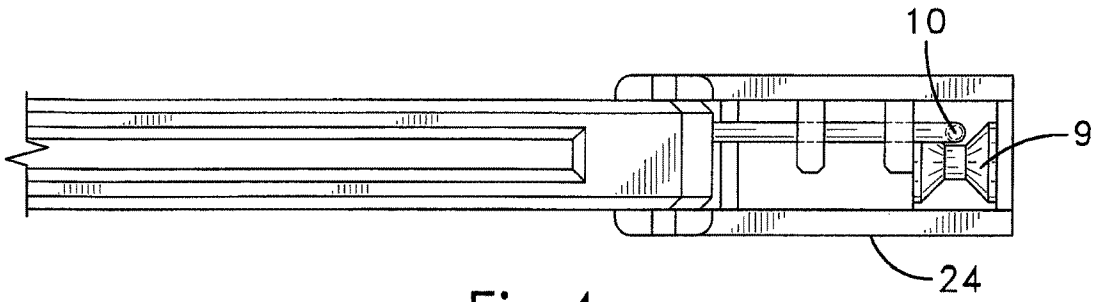

For the application of the viscous material the applicator is placed against the component edge by its guide roller 9, and the start button 25 of the cartridge applicator gun 21 is pressed. Consequently, the viscous material emanates from the nozzle while the user at the same time moves the applicator with the guide roller along the component edge. Due to the very considerable adjustment options in the direction parallel to the surface normal on the component edge because of the parallelogram guide, based on the spring action the applicator readily compensates for any movement inaccuracies of the user so that a constant distance between the nozzle and the component edge is ensured at all times. Lastly, FIG. 4*e* shows the detail B from FIG. 4*c*, in which detail B the arrangement of the nozzle 10 directly behind the guide roller 9 is shown.

Figure 5:
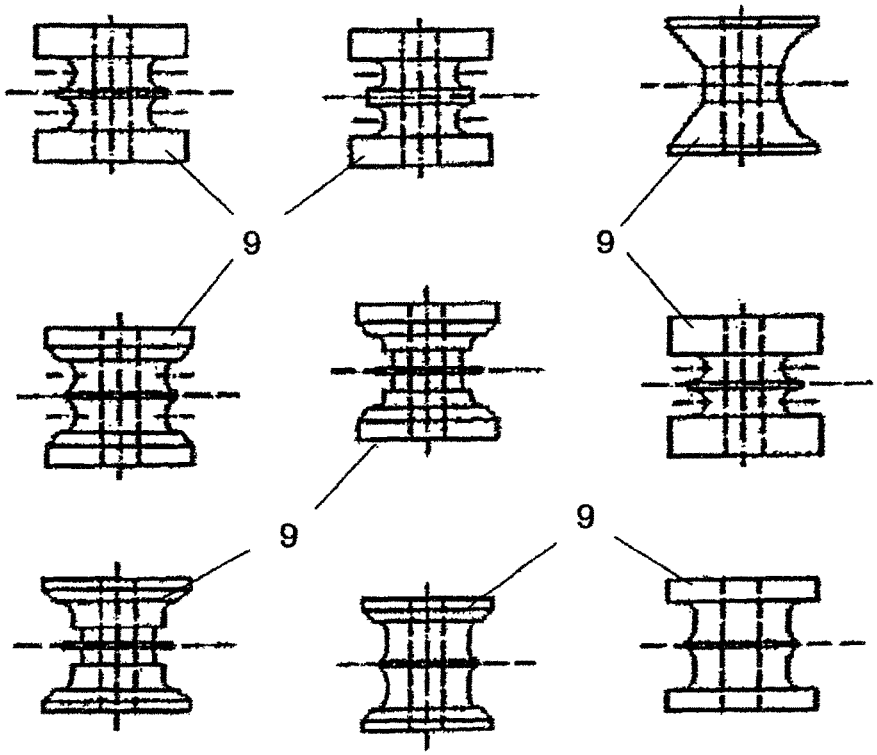
FIG. 5 shows examples of different embodiments of the guide roller of the proposed applicator.

In the proposed applicator the cross-sectional shape of the guide roller can have various geometries. Particularly when the guide roller is arranged so as to be behind the nozzle in the infeed direction, with a clever selection of the geometry or the roll shape in combination with the infeed speed above the component and the volume flow of the viscous material, the bead geometry can in a targeted manner be matched to the specifications by the guide roller. Merely by way of examples, FIG. 5 shows just some possible roller shapes. The ratios of width to diameter of the individual segments, shown in the figure, of the guide roller 9, which guide roller 9 can, for example, have a width of 8 mm, and on both sides a diameter of 6 mm, can of course vary, depending on the particular application.

LIST OF REFERENCE CHARACTERS

1 Nozzle aperture for viscous material
2 Nozzle channel for viscous material
3 Nozzle aperture for air outlet
4 Nozzle channel for air supply
5 Infeed direction
6 Robot flange
7 Spring
8 Angle lever
9 Guide roller
10 Nozzle
11 Laser sensor
12 Laser beam
13 Direction of movement parallel to the surface normal
14 Direction of movement perpendicular to the surface normal and the infeed direction
Nozzle head
16 Sliding block guide
17 Mounting plate
18 Spring
19 Material hose.
20 Spring
21 Cartridge applicator gun
22 Connector element
23 Parallelogram guide
24 Applicator head
25 Start button

The invention claimed is:

1. A combination nozzle for applying a viscous material to a surface, comprising:
a first nozzle channel for the viscous material, which nozzle channel leads to a first nozzle aperture, and
a second nozzle channel for a gaseous medium, which nozzle channel leads to a second nozzle aperture,
characterised in that
the two nozzle channels extend at an angle to each other, which angle is between 0° and 10°, and the two nozzle apertures have a width of between 3 and 6 mm that is greater than their length, and are arranged in the longitudinal direction one behind the other at a centre distance of between 3 and 5 mm.

2. The combination nozzle according to claim 1,
characterised in that
the length of the nozzle apertures is ≤2 mm.

3. The combination nozzle according to claim 1,
characterised in that
the second nozzle aperture is arranged so as to be offset rearwards in the direction parallel to the longitudinal axis of the first nozzle channel by a distance of 4±1 mm relative to the first nozzle aperture.

4. A device for applying a viscous material to an edge of a component, along which edge the device is moved in an infeed direction during an application process, comprising:
a nozzle for the viscous material in or on a nozzle mount, wherein the nozzle is a combination nozzle comprising:
a first nozzle channel for the viscous material, which nozzle channel leads to a first nozzle aperture, and
a second nozzle channel for a gaseous medium, which nozzle channel leads to a second nozzle aperture,
characterised in that
the two nozzle channels extend at an angle to each other, which angle is between 0° and 10°, and the two nozzle apertures have a width of between 3 and 6 mm that is greater than their length, and are arranged in the longitudinal direction one behind the other at a centre distance of between 3 and 5 mm,
a guide roller affixed to the nozzle or the nozzle mount in such a manner that for applying the viscous material it is placed to the edge and moved along the edge to ensure a defined position of the nozzle relative to the edge,
a connector element connects the device to a handling device, a handle or a cartridge, and
a connecting mechanism by way of which the nozzle mount is connected to the connector element,
wherein the connecting mechanism is designed in such a manner that at least in a first direction parallel to a surface normal on the edge it allows a relative movement of the nozzle mount relative to the connector element, and has a spring mechanism by means of which the guide roller is pressed against the edge during the application process.

5. The device according to claim 4,
characterised in that
the connecting mechanism is an angle lever.

6. The device according to claim 5,
characterised in that
a sensor for acquiring movements of the angle lever is arranged to be connected to a control system of a handling device in order to transmit data for possible track correction to said control system.

7. The device according to claim 4,
characterised in that
the connecting mechanism is designed in such a manner that it also allows a relative movement of the nozzle mount relative to the connector element in a second direction perpendicular to the infeed direction and across the first direction.

8. The device according to claim 4,
characterised in that
the connecting mechanism is a parallelogram guide.

9. The device according to claim 4,
characterised in that
the guide roller is arranged so as to be behind the nozzle in the infeed direction and is designed in such a manner that when the device is moved in the infeed direction it forms the viscous material applied through the nozzle.

10. The combination nozzle according to claim 1, wherein said centre distance between said first nozzle channel and said second nozzle channel and said angle therebetween results in the viscous material being first applied to the surface and the gaseous material being later applied to the viscous material as the surface is moved relative to the combination nozzle.

11. The combination nozzle according to claim 10, wherein said second nozzle channel follows at a short fixed, non-intersecting distance from said first nozzle channel as the surface is moved relative to the nozzle.

* * * * *